US008215577B2

(12) United States Patent
Gordon et al.

(10) Patent No.: US 8,215,577 B2
(45) Date of Patent: Jul. 10, 2012

(54) SYSTEM AND METHOD FOR STORAGE AND TEMPORARY INSTALLATION OF SECONDARY FLOORING SURFACE

(75) Inventors: Stephen Douglas Gordon, Cohutta, GA (US); Gary Lynn Brock, Dalton, GA (US); Andrew E. Belles, Chatsworth, GA (US); Ryan Whitman Paris, Ringgold, GA (US); William Bryan Peeples, Ringgold, GA (US)

(73) Assignee: Textile Managment Associates, Inc., Dalton, GA (US)

( * ) Notice: Subject to any disclaimer, the term of this patent is extended or adjusted under 35 U.S.C. 154(b) by 342 days.

(21) Appl. No.: 12/701,332

(22) Filed: Feb. 5, 2010

(65) Prior Publication Data

US 2010/0200688 A1 Aug. 12, 2010

Related U.S. Application Data

(63) Continuation-in-part of application No. 12/562,773, filed on Sep. 18, 2009.

(60) Provisional application No. 61/177,073, filed on May 11, 2009, provisional application No. 61/207,030, filed on Feb. 6, 2009, provisional application No. 61/098,543, filed on Sep. 19, 2008.

(51) Int. Cl.
*B65H 75/48* (2006.01)
*B65H 75/40* (2006.01)

(52) U.S. Cl. ..... 242/390.2; 242/390.9; 242/403; 242/919

(58) Field of Classification Search ..... 242/389, 242/390, 390.2, 390.8, 390.9, 398, 400, 403, 242/544, 557, 564, 919
See application file for complete search history.

(56) References Cited

U.S. PATENT DOCUMENTS 3,099,444 A 7/1963 Burt
3,108,804 A * 10/1963 Wagner ..... 473/504
(Continued)

FOREIGN PATENT DOCUMENTS

DE 2417729 10/1975
(Continued)

OTHER PUBLICATIONS

International Application No. PCT/US2010/023319, International Preliminary Report on Patentability mailed on Aug. 18, 2011, 5 pages.

(Continued)

*Primary Examiner* — William E Dondero
(74) *Attorney, Agent, or Firm* — Kilpatrick Townsend & Stockton LLP

(57) ABSTRACT

Systems and methods of rolling and unrolling secondary flooring surfaces, such as tall pile turf, are provided. The system includes a core onto which the secondary flooring surface is rolled, the core being coupled on both ends to a frame that moves along a track mounted on or in a primary surface. The system includes a drive system that allows for the conversion of a primary surface into a secondary flooring surface in a relatively short period of time. The drive system includes core adjustable speed drive units for controlling the speed and torque of the motors that drive the core, as well as frame adjustable speed drive units for controlling the speed of the movement of the frames along the tracks. The core adjustable speed drive units control the torque of the core motors during roll up and control the speed of the core motors during roll out.

20 Claims, 7 Drawing Sheets

U.S. PATENT DOCUMENTS

| | | | | |
|---|---|---|---|---|
| 4,084,763 | A | 4/1978 | Zamboni | |
| 4,399,954 | A | 8/1983 | Arrant | |
| 4,588,189 | A | 5/1986 | Arrant | |
| 4,640,469 | A | 2/1987 | Mackintosh | |
| 4,738,407 | A | 4/1988 | Arrant | |
| 5,456,566 | A | 10/1995 | Kniley et al. | |
| 5,962,101 | A | 10/1999 | Irwin, Sr. et al. | |
| 6,070,824 | A | 6/2000 | Du Pont | |
| 6,435,443 | B1 * | 8/2002 | Lauritzen | 242/390.9 |
| 2010/0072315 | A1 | 3/2010 | Gordon | |
| 2011/0119823 | A1 * | 5/2011 | Coenraets | 4/498 |

FOREIGN PATENT DOCUMENTS

| | | | |
|---|---|---|---|
| JP | 07206232 | | 8/1995 |
| WO | WO 2010033840 | A1 | 3/2010 |
| WO | WO 2010091252 | A1 | 12/2010 |

OTHER PUBLICATIONS

International Application Serial No. PCT/US2010/023319, International Search Report mailed Jul. 20, 2010.

International Application Serial No. PCT/US2010/023319, Written Opinion mailed Jul. 20, 2010.

"The AstroTurf Engineered, One-Piece Turf Conversion System, Magic Carpet," AstroTurf Sports Surfaces Brochure, Jun. 1998.

"Your Pitch Covered in Minutes," Matchsaver Automated Pitch Protection Brochure, 2002.

"Maximize Your Venue Potential, Minimize Your Conversion Time, Conversion Systems," AstroTurf Brochure, 2007.

PCT/US2009/057534 International Search Report and Written Opinion dated Feb. 1, 2010.

International Application No. PCT/US2009/057534, International Preliminary Report on Patentability mailed on Mar. 31, 2011, 8 pages.

* cited by examiner

SYSTEM AND METHOD FOR STORAGE AND TEMPORARY INSTALLATION OF SECONDARY FLOORING SURFACE

CROSS-REFERENCE TO RELATED APPLICATIONS

This application is a continuation-in-part application of U.S. Ser. No. 12/562,773, filed Sep. 18, 2009 and titled "System and Method for Storage and Temporary Installation of Secondary Flooring Surface," which claims priority to U.S. Provisional Application Ser. No. 61/098,543, filed Sep. 19, 2008 and titled "System and Method for Storage and Temporary Installation of Artificial Turf," and U.S. Provisional Application Ser. No. 61/177,073, filed on May 11, 2009 and titled "System and Method for Storage and Temporary Installation of Secondary Flooring Surface," the entire contents of all of which are incorporated herein by reference. This application also claims priority to U.S. Provisional Application Ser. No. 61/207,030, filed Feb. 6, 2009 and titled "System and Method for Storage and Temporary Installation of Secondary Flooring Surface," the entire contents of which are incorporated herein by reference.

BACKGROUND OF THE INVENTION

Artificial turf, also known as synthetic turf, is a surface manufactured from synthetic materials designed to look and perform like natural grass. Artificial turf is commonly used in the athletic industry and is also used in both commercial and residential landscaping applications. Artificial turf may be formed from nylon fibers and/or polyethylene fibers, among others. Some artificial turf surfaces use an infill material between the artificial fibers and are referred to as "infill surfaces." The infill material is comprised of "resilient" granules, which may be made of, for example, rubber, cryogenically ground rubber, EPDM rubber, cork, polymer beads, polymer foam, styrene, perlite, neoprene, sand, gravel, or granulated plastic, among other materials.

Artificial turf is desirable when the use of natural turf is inconvenient, expensive, or unfeasible. Some climates force athletic teams indoors for training and practice and, depending on the sport, a soft or grass-like surface may be necessary. Professional sports teams may be located in climates that necessitate the use of artificial turf in an indoor stadium.

Systems providing a portable, removable, and storable artificial turf or other secondary flooring surface are beneficial because they allow use of both a primary and secondary flooring surface in a single venue. For example, a secondary flooring surface may be temporarily placed on a gymnasium floor or other primary surface for selected sports and activities and later removed.

At least one existing installation system designed to unroll temporary artificial turf is capable of accommodating only products formed from short pile knitted nylon with a knitted backing that is coarser, yet more durable, than other turfs. This type of existing system was specifically designed for use with short pile knitted nylon type turf and is not capable of deploying turf systems formed from other materials or systems with tall pile heights. Even when used with knitted nylon turf, this type of existing system has drawbacks, such as roll telescoping as it is rolled up or sagging as the roll is rolled out. Moreover, this type of existing system can only be operated at one speed that cannot be controlled. This lack of system control leads to directionality issues and can lead to the turf creasing, tearing, and distorting.

Artificial turf formed from polyethylene fibers has been used because it is relatively softer and taller than traditional nylon products, and can be tufted. Polyethylene artificial turf has a pile height that is about two inches higher than the short and compact traditional nylon artificial turf, which is typically no higher than ½ an inch in height.

Attempts to roll and unroll an artificial turf having tall pile polyethylene fibers using at least one existing installation system result in broken backings, slipping, and bagging that congregates at either end of a roll. For example, the taller polyethylene fibers cause the roll to slip as it is unrolled and rolled. Slippage is undesirable because it can result in damage to the artificial turf. In contrast, nylon artificial turf has more "grip," because the nylon fibers are not as slippery, allowing a more even roll-up process. Thus, existing systems cannot deploy newer types of artificial turf, such as ones comprised of tall pile, including those comprised of polyethylene fibers and infill systems.

Although some conventional systems are capable of rolling and unrolling taller pile heights, including polyethylene fibers, these systems can only accommodate narrow sections of artificial turf or other secondary flooring on a roll and are pile height dependent, and therefore the artificial turf or other secondary flooring is limited to a narrower width. With these existing systems, the machine moves to roll up and unroll the artificial turf, and the artificial turf remains stationary. Because the turf remains stationary, these conventional systems require lift trucks to transport the rolls. This limits the width of the roll that can be used because these lift trucks cannot handle the weight of a single roll of artificial turf or other secondary flooring or handle a roll if it is too wide.

Thus, these conventional systems can only accommodate narrow rolls, and therefore require many pieces of artificial turf or other secondary flooring to cover an existing primary surface. These pieces are rolled into separate rolls, so a large storage area is required to store all of the numerous rolls of artificial turf or other secondary flooring. When these separate rolls are unrolled, the individual pieces must be seamed together to form the secondary flooring surface. Furthermore, when the rolls are unrolled to lay out the secondary flooring system, these pieces must be installed in the proper order, which is cumbersome and time consuming. Unrolling artificial turf or other secondary flooring with conventional systems is time consuming and can require as much time as an hour or more per roll. Thus, rolling up a secondary flooring surface, such as an athletic field, and storing the rolls could take up to 5-7 hours or more using a conventional system.

Conventional carpet roll up systems are not suitable for use with artificial turf because the tensioning of carpet roll up systems is not appropriate for artificial turf and other types of flooring other than carpet. The conventional method of tensioning carpet cannot be accomplished on artificial turf because the machine cannot accommodate the wide width of turf. If the system is made wide enough to accommodate turf, additional support would be necessary, which would then interfere with the threading process.

Thus, there is a need for a system capable of effectively rolling and unrolling secondary flooring surfaces, such as tall pile artificial turf, including tall pile polyethylene turf, and/or infill systems. There is also a need for a system capable of rolling and unrolling secondary flooring surfaces having a greater roll width and weight. There is also a need for a system that is capable of efficiently rolling up and unrolling a variety of secondary flooring surfaces, including but not limited to, tufted or knitted products, tall or short pile products, rubberized flooring systems, floor coverings, natural sod, infilled and non-infilled products, or any other surface used to cover and/or protect a primary surface. There is further a need to provide a system capable of accommodating multiple types of secondary flooring surfaces in a single venue. These secondary flooring surfaces are not limited to those used in the athletic industry.

SUMMARY OF THE INVENTION

Provided are systems and methods of rolling and unrolling secondary flooring surfaces, such as tall pile turf, and any other floor covering that covers and/or protects a primary surface. The system includes a core, two frames, with each frame being coupled to an end of the core, and two sets of tracks along which each of the two frames moves. The system also includes a drive system that allows for the conversion of a primary surface into a secondary flooring surface in a relatively short period of time. In some embodiments, the system includes a core that is driven by at least one core motor that is controlled by a core drive unit. In some embodiments, the frame is driven by at least one frame motor that is controlled by a frame drive unit. In some embodiments, the drive system includes core adjustable speed drive units for controlling the speed and torque of the motors that drive the core, as well as frame adjustable speed drive units for controlling the speed of the frame as it moves along the track. The core adjustable speed drive units control the torque of the core motors during roll up and control the speed of the core motors during roll out.

DETAILED DESCRIPTION

Figure 1:
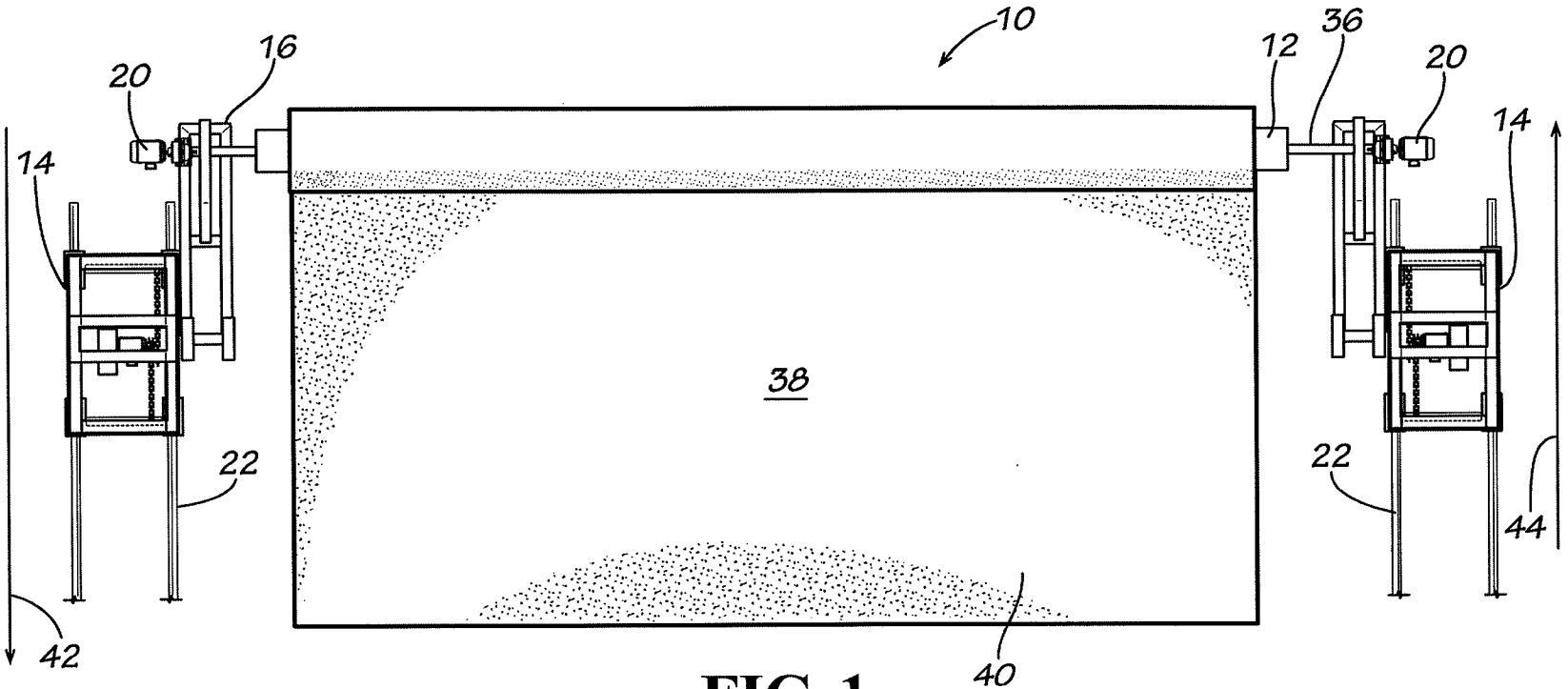
FIG. 1 is a top view of an embodiment of a system for storage and temporary installation of a secondary flooring system as the primary surface is being converted.

Systems and methods of this invention store and install and un-install a temporary secondary flooring surface 40, such as artificial turf, carpet, rubberized flooring, natural sod, or other suitable secondary flooring, on an existing primary surface 38. For example, systems of this invention unroll a secondary flooring surface to cover temporarily a primary surface, such as a gymnasium floor or a domed stadium. After use, the secondary flooring surface can be rolled up for storage. Systems and methods of this invention allow the conversion of a large primary surface to a secondary flooring surface in a short period of time with a limited amount of labor. The primary surface may be generally flat, or may be domed to allow for drainage. The secondary flooring surface may optionally include a pad underneath to provide additional strength, cushioning, and stability to the secondary flooring surface.

Systems of this invention also allow the user to choose from a number of different types of secondary flooring surfaces such as, but not limited to, a tufted or knitted product, a tall or short pile product, rubberized flooring systems, natural sod, carpet, an infilled or non-infilled surface, or any other suitable surface for covering and/or protecting a primary surface. All of these secondary flooring surfaces may be unrolled onto a primary surface and then rolled up and removed. In one embodiment, for example, systems of this invention roll up and unroll a tall pile, infilled synthetic artificial turf in a short period of time. The time required for converting a primary surface to the secondary flooring surface depends, in part, on the square footage of the primary surface, and in particular the length of the primary surface.

Some benefits of systems of this invention include lack of distortion, stretching, and bunching of the secondary flooring surface, reduced infill migration and loss, and reduced damage and distortion of the secondary flooring surface. In other words, the secondary flooring surface is rolled up and is unrolled evenly and neatly and more efficiently. An uneven roll up process would likely result in product damage to the secondary flooring surface. Moreover, an uneven roll up process would likely result in congregating and bunching of the secondary flooring surface in certain spots, which could affect surface performance or athletic performance and eventually result in a non-functioning system. Another benefit of systems of this invention is that the system could be portable, and may be used in a variety of different facilities such as a multipurpose gymnasium or an outdoor stadium.

Some embodiments of this invention roll up and unroll a secondary flooring surface on a core that is generally the same width as the primary surface. In this way, the secondary flooring surface can be installed on the primary surface from a single roll, which is faster and easier than creating a secondary flooring surface from several fragmented rolls. These embodiments of this invention also allow the rolled up secondary flooring surface to be rolled up into a single roll and then stored as a single roll.

In certain embodiments according to the invention, as shown in FIGS. 1-4, the conversion system 10 includes a core 12 formed from steel or other suitable material. Conversion system 10 may be mounted directly on the primary surface 38. The secondary flooring 40 is rolled around the core 10 during the roll up process. As shown in FIG. 1, the conversion system 10 includes at least one frame 14 and at least one track 22. In some embodiments, track 22 runs generally along the entire length or width of the primary surface 38. In some embodiments, track 22 is permanently mounted in a trough below the primary surface 38. In these embodiments, track 22 may be covered when the system is not in use. In other embodiments, track 22 may be temporarily mounted directly on the primary surface 38 and removed when the system is not in use.

In the embodiment shown in the Figures, conversion system 10 includes two frames 14 and two tracks 22. Specifically, a frame 14 is coupled to both ends of core 12, with each frame being movable along a track 22. Frame 14 is illustrated as generally A-shaped to provide stability to the frame, although frame 14 may be of any suitable shape and configuration.

Figure 2:
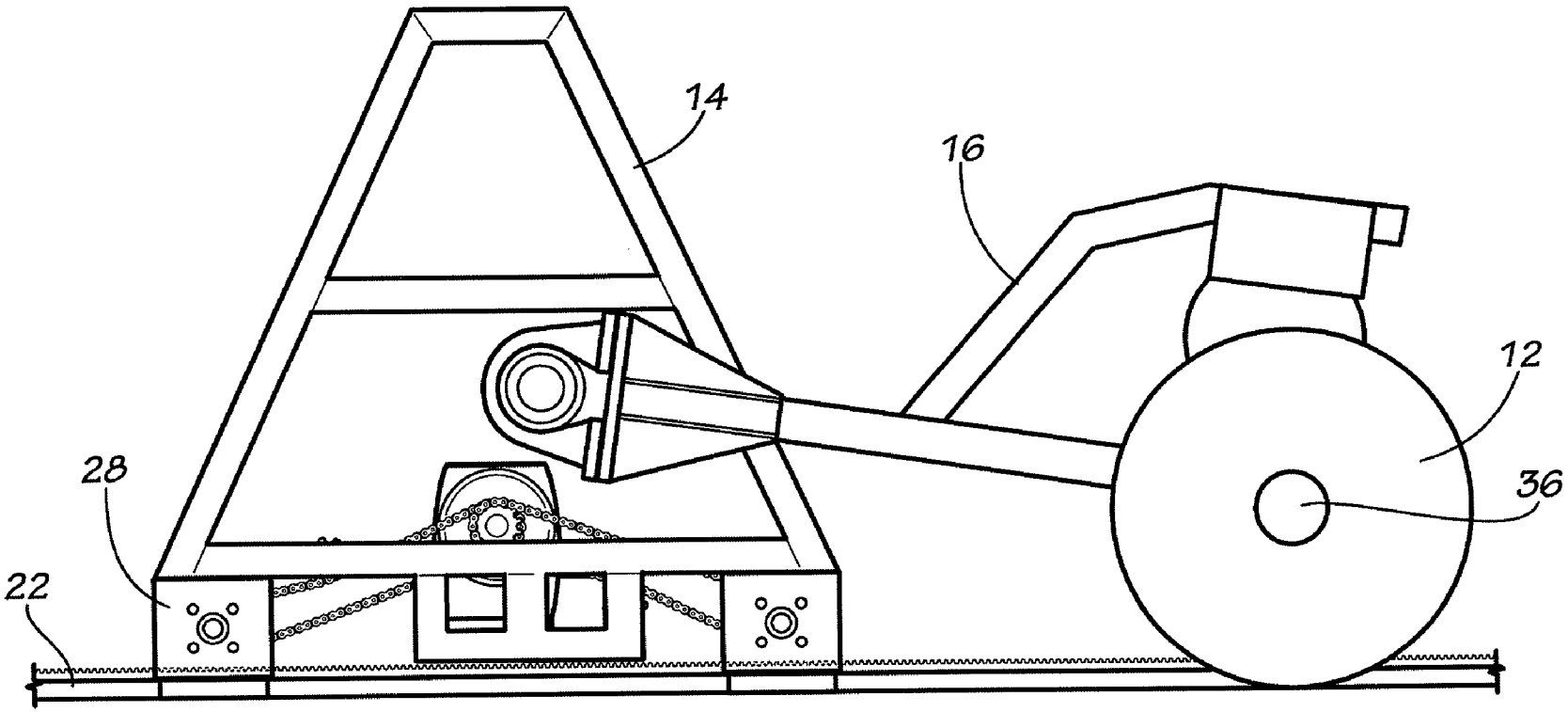
FIG. 2 is an end view of the system of FIG. 1.
Figure 3:
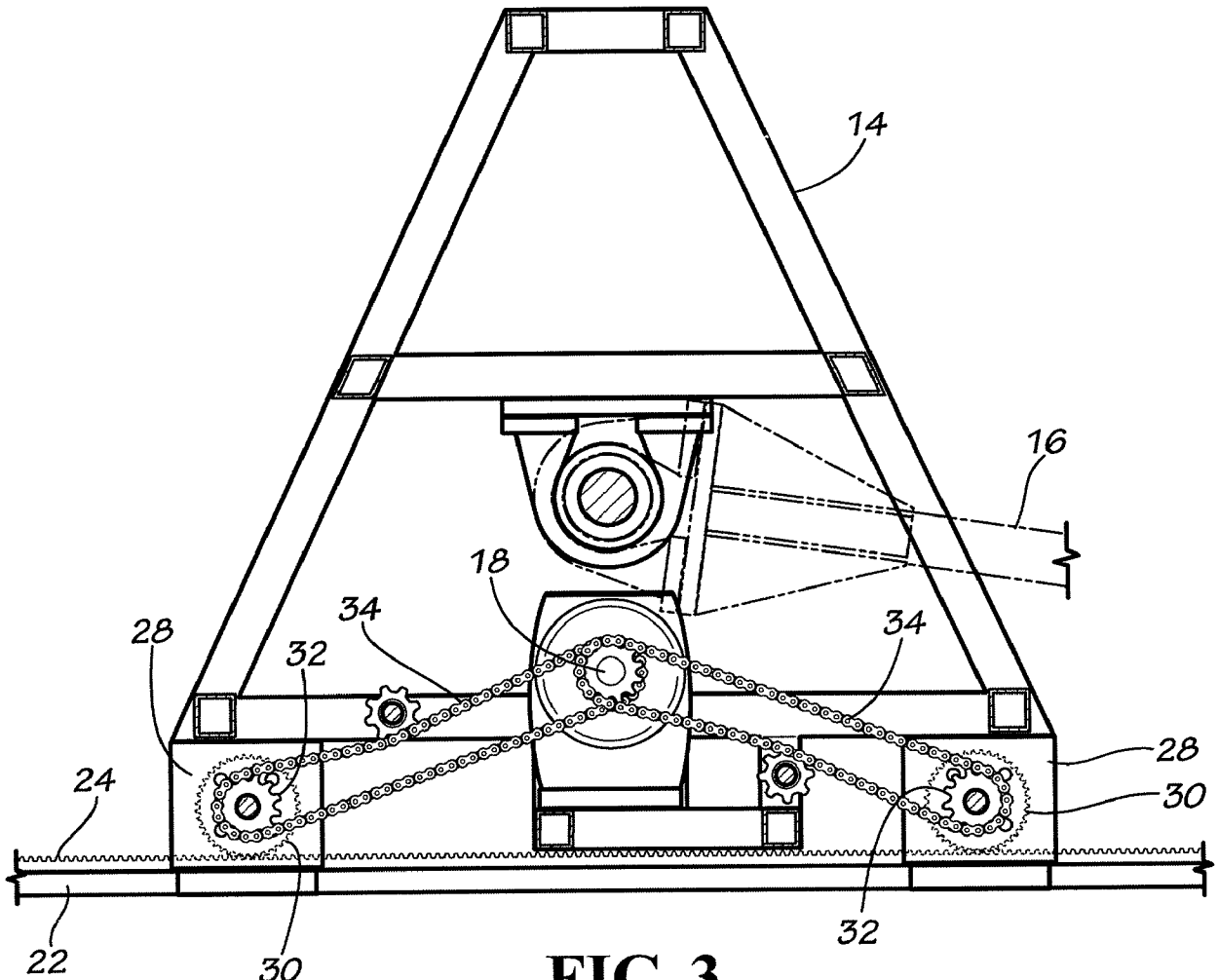
FIG. 3 is a partial cross sectional view of the system of FIG. 2.

As shown in FIGS. 2-3, frame 14 is coupled to, and movable along, track 22. Track 22 includes rack gears 24, shown in FIG. 3, or any other suitable gear tooth. In some embodiments, track 22 is attached to the primary surface 38 so that it is flush, trench, or otherwise mounted. Frame 14 includes a plurality of gear boxes 28, which house sprocket 32 and at least one spur gear 30, or other suitable gear, as shown in FIG. 3. As described below, spur gear 30 cooperates with the rack gears 24 of track 22 as the frame 14 traverses along track 22 as the secondary flooring surface 40 is rolled or unrolled around the core 12 during a roll up or roll out process. In the embodiment illustrated in the Figures, each frame 14 includes four gear boxes 28, although fewer or more gear boxes 28 may be used.

Conversion system 10 also includes a drive mechanism to power the frame 14 along the track 22. As shown in FIGS. 2-3, one such suitable drive mechanism includes a frame motor 18. Drive mechanism can also include gear reducers at one or both ends in certain embodiments. During the roll up or roll out process, the frame motor 18 drives the frame 14 along the track 22. Specifically, frame motor 18 engages chain 34 and sprocket 32, which in turn engages spur gear 30. The teeth of spur gear 30 cooperate with the gear teeth 24 of track 22 to drive frame 14 along track 22.

Figure 4:
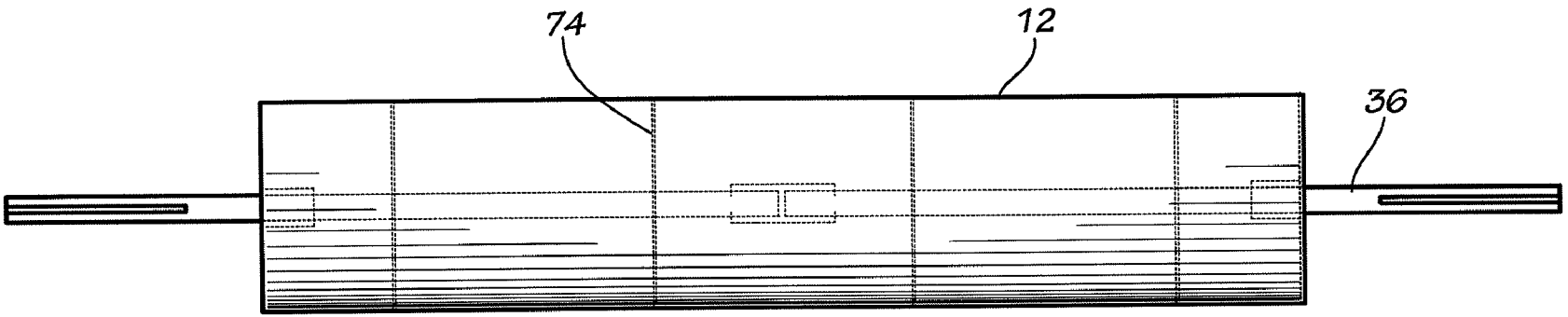
FIG. 4 is a partial top view of a core according to one aspect of the invention.
Figure 5:
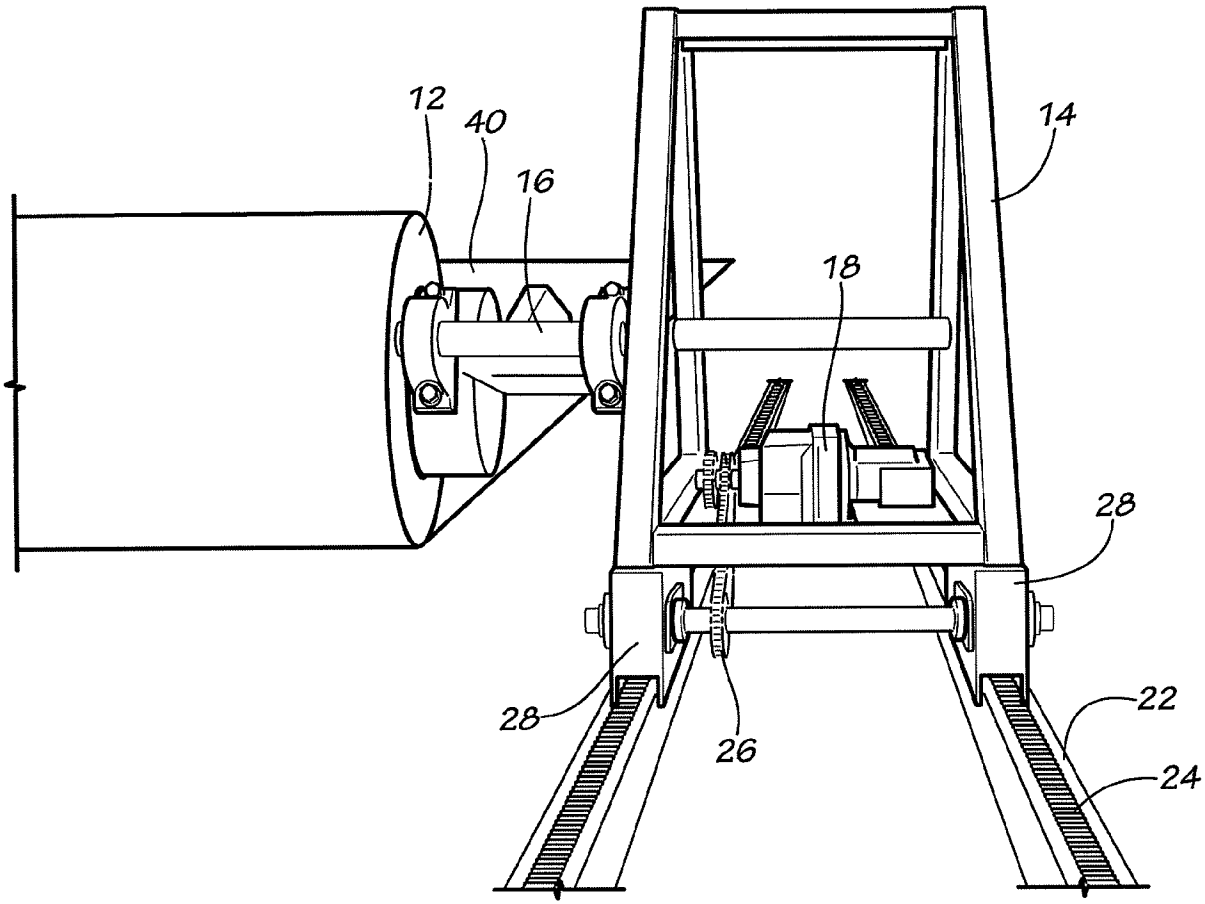
FIG. 5 is a partial perspective front view of the system of FIG. 1.
Figure 6:
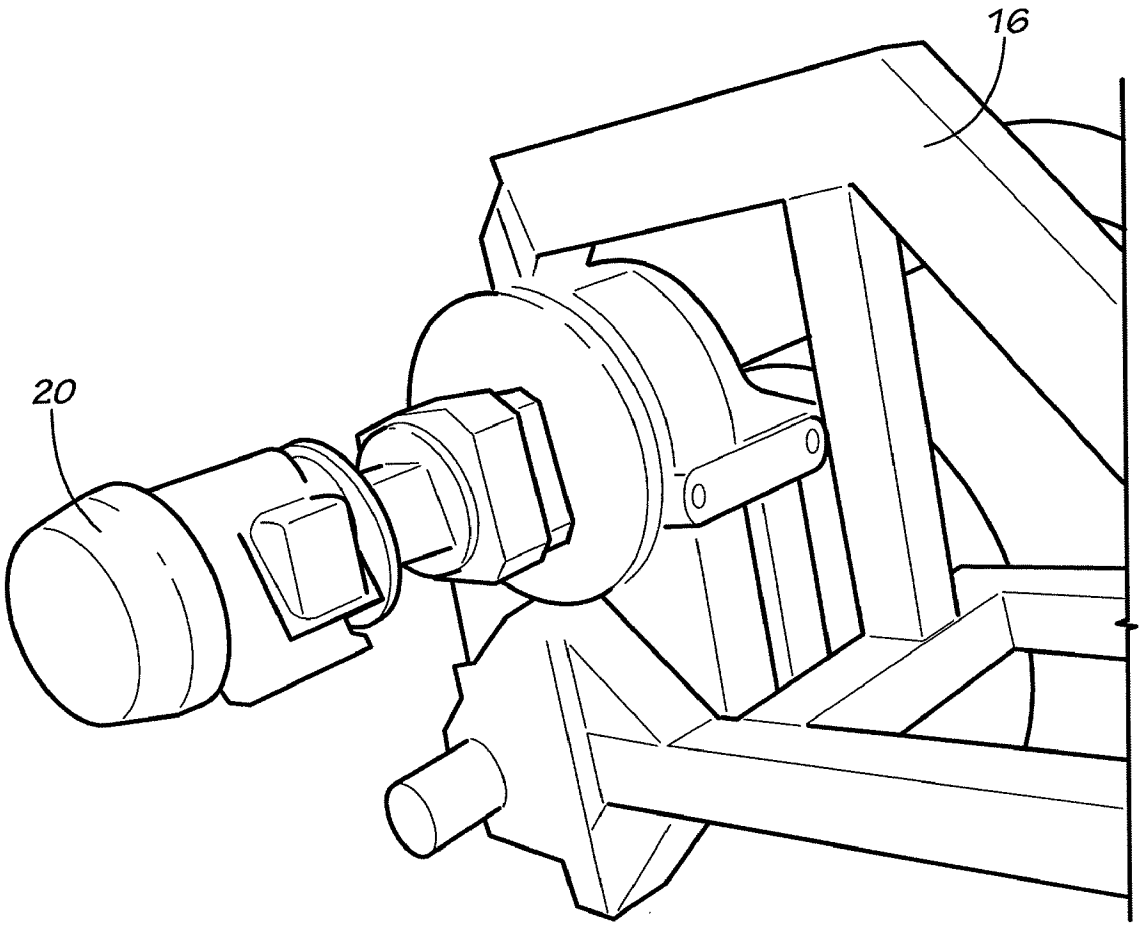
FIG. 6 is perspective side view of the system of FIG. 1.
Figure 7:
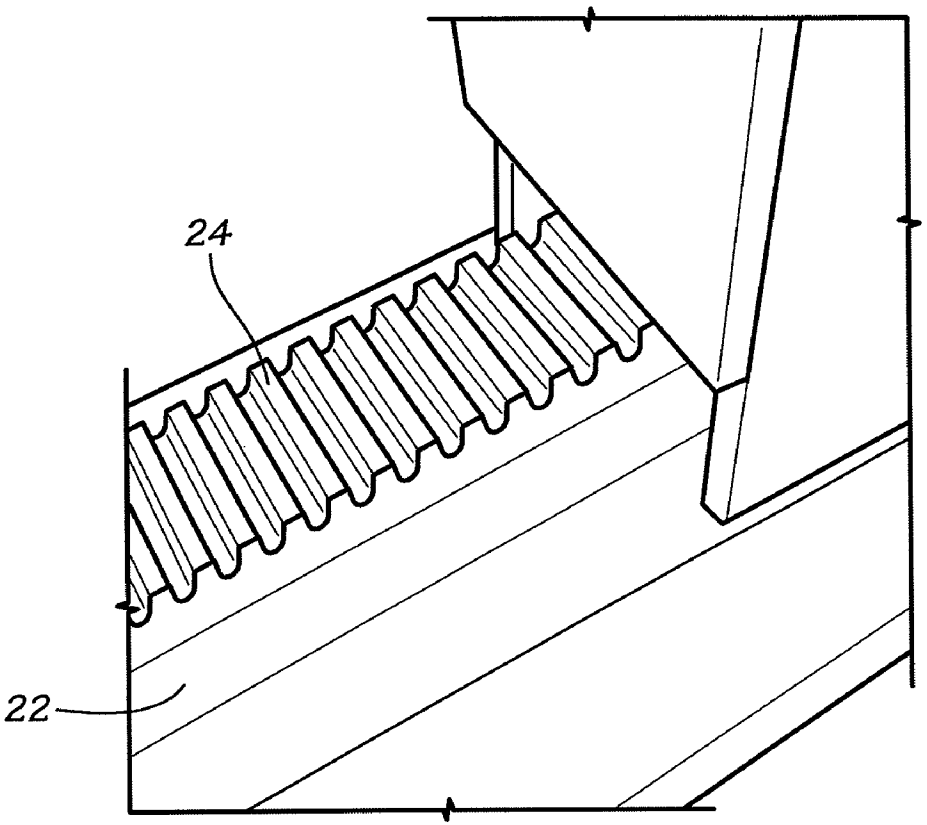
FIG. 7 is an enlarged view of a portion of the track of the system of FIG. 1.

As shown in FIG. 1, a core motor 20 is located at each end of core 12 and is coupled to frame 14 via an arm 16. FIG. 4 illustrates a portion of the core 12 and the center shaft 36. The core includes steel support headers 74. In one embodiment, the support headers 74 are provided on 5 foot centers along the length of the core. The center shaft 36 extends from the core 12 and the rotation of center shaft 36 causes core 12 to rotate. Core motors 20 provide the power necessary to turn the core 12 and roll the secondary flooring 40 onto the core 12 as the frames 14 progress along the length of tracks 22. In this way, the core 12 becomes a center winder driven by the core motors 20. This center winder acts with the drive mechanism of the frames 14 to roll up the secondary flooring surface 40 around the core 12. A variety of different sized cores may be used with conversion system 10, depending on the type of secondary flooring to be installed on primary surface. In one embodiment, the diameter of the core is 36 inches, although the system can utilize multiple size core diameters. If a different type of secondary flooring 40 is desired, the existing core 12 is replaced with another core housing the desired type of secondary flooring.

In one embodiment, each of the core motors 20 and the frame motors 18 are controlled by a separate adjustable speed drive unit. Exemplary motors and drive units for one embodiment include 7.5 hp, 480 volt, 3 phase, 1750 RPM motors and G9 Adjustable Speed Drives (7.5 hp model), both available from Toshiba. Although this embodiment uses the same size motors to drive both the core and the frame, other embodiments may use different motors to drive the core and the frame. A core drive unit supports at least a torque mode and a speed mode and can control the core motors in both modes. The core drive unit may be shaft mounted to the core (shown), or alternatively may be belt driven, mounted via a chain and sprocket, or coupled to the core in any other suitable manner. For some embodiments, the core drive unit is an adjustable speed drive unit to vary the speed of the core 12 during roll out. The core motors 20 have sufficient power to drive the core 12 when the secondary flooring 40 is rolled onto the core 12. A frame drive unit provides a speed mode and can control the speed of the frame motor 18. The core drive unit and the frame drive unit may be independent from one another, or may communicate with each other using a communication system to adjust the speed to ensure that constant tension is maintained during roll up. Although the Figures illustrate that the core and the frame are driven by a pair of motors, not all embodiments use a pair of motors. Depending on the width and/or length of the secondary flooring surface, the frame and/or the core may be driven by a single motor at each end of the core, or more than two motors at each end of the core.

Sand or other material, such as a liquid, may be added to the core 12 in some embodiments. If so, the material is added to the middle section of the core and tapers down towards the ends. For example, there is sand in a predetermined section of the core in one embodiment, which could be centered at the midpoint of the core. The sand is distributed so that it is heaviest at the midpoint of the core and tapers down as it approaches the ends of the section. Without the sand, the heaviest part of the core in this embodiment is towards the ends of the core and the secondary flooring 40 is thus susceptible to wrinkling toward the ends of the core as the secondary flooring is rolled onto the core. The sand helps equalize the weight of the core and also facilitates a more even roll up process of the secondary flooring material onto the core.

The core 12 is mounted at each of its ends on a movable arm 16, the arm 16 being capable of moving up and down via a pivot point at either end of the core 12 as the roll of secondary flooring 40 increases or decreases in diameter around the core 12, as further described below. Allowing the core 12 to float up and down via the arm 16 helps to maintain an approximately constant tension during the roll up and roll out processes.

In other embodiments, for example, if the core 12 is mounted directly to the frame 14 without use of arm 16, an optional hydraulic lift may be used at either end of the core 12 to assist with lifting and lowering the core 12. Specifically, as a cylinder in the hydraulic lift extends, pressure forces a piston upward to help support the weight of the core 12. As the cylinder extends, constant pressure is maintained to raise the core 12 at a steady rate. A relief valve may be used to maintain constant pressure as the core is lowered.

In some embodiments a linear voltage displacement transducer ("LVD") is used to determine the position of the core 12 and provide the information to the core adjustable speed drive units. In other embodiments, the position may be determined by the position of the center shaft 36 relative to the primary surface 38. In any of these embodiments, the position of the core provides information about the roll diameter and can be used during the roll out process. The LVD is not necessary in all embodiments.

In the embodiment shown in the Figures, the conversion system 10 includes two frames 14 and two sets of tracks 22. In some embodiments, the frames 14 operate independently of one another. In other words, the movement of one frame 14 is not linked to the movement of the other frame 14. In these instances, a registration process may be utilized to register the position of one frame 14 relative to the position of a second frame 14. In this way, the registration process ensures alignment of the two frames relative to one another before and during roll up and roll out of a secondary flooring 40. In some embodiments, the registration process consists of counting the number of gear teeth 24 on each track 22 to determine the respective position of the frame along the track, and then comparing the position of one frame to the position of the other frame and communicating that position. In some embodiments, a processor-based controller counts the number of gear teeth and makes the comparison between the two frames. Based on this comparison, an automatic adjustment can occur if the position of the frames on the tracks relative to one another is not the same. For example, once the relative position of one of the frames 14 is communicated, the processor-based controller can adjust the relative speeds of the frames can be made. In one embodiment, the frame motor 18 of one frame 14 speeds up, in another embodiment the frame motor 18 of the other frame 14 slows down, and in yet another embodiment, the frame motor 18 of one frame speeds up while the other frame motor 18 slows down. In some embodiments, the processor-based controller includes a hardwire connection, although the communication system could also be wireless.

Also disclosed are methods of rolling up and unrolling a secondary flooring 40 using the system described above. In some embodiments, the system is programmed to roll up a secondary flooring system using the system described above at a speed of approximately 20 ft/min. Similarly, in some embodiments, the system is programmed to unroll a secondary flooring system using the system described above at a speed of approximately 20 ft/min. To begin the roll up process, the core motor 20 controlling the core 12 and frame motor 18 are started and are configured to drive the frames 14 along the tracks 22 in a first direction 42 as the core 12 rotates so that the secondary flooring 40 rolls onto the core 12 as the frames 14 traverse along the tracks 22. Although secondary flooring 40 is illustrated in FIG. 1 as rolled up in first direction 42, secondary flooring 40 could be rolled up in the opposite direction. The frames 14 on either end of the core 12 are guided along the track 22 via the rack and spur gears 24 and 30.

As discussed above, the core 12 becomes a center winder that helps roll up the secondary flooring surface 40. During roll up, the frame drive units are programmed to maintain a fixed speed and the speed of the core 12 adjusts to maintain a predetermined torque setting of the core 12 as the frames 14 progress along the tracks 22 and the secondary flooring is wrapped around the core. During the roll up process, the frame motors 18 are in a brake mode to maintain the predetermined fixed speed and to slow the speed of the core 12. The desired torque setting of the core 12 during roll up is determined by the weight of the secondary flooring that is utilized with the system. The speed is typically determined by the desired roll up/roll out time and the length of the secondary flooring 40. The roll up time is the time it takes to roll the secondary flooring onto the core 12 and the roll out time is the time it takes to roll the secondary flooring 40 off the core 12.

The frame motors operate at the predetermined fixed speed, subject to any adjustments based on the registration process described above. In these instances, once the position of the frames 14 are realigned, the speed of the frame motors reverts back to the predetermined fixed speed.

The core adjustable speed drive units are programmed to set the torque for the core motors 20 to provide a relatively tight roll given the speed of the frame motors and the amount and type of the secondary flooring 40. Because the system accommodates secondary flooring surfaces of different types, for example, turf made from different yarn, construction, pile height, and in-fill, among others, it is desirable for the system to be able to adjust the motor parameters to fit the particular type of secondary flooring surface 40 used and the specific needs of each venue, especially if multiple types of secondary flooring surfaces are to be used. The amount and type of the secondary flooring 40 determine the weight and diameter of the secondary flooring 40 when it is rolled on the core 12. The tightness of the roll is acceptable when the secondary flooring 40 can roll out without wrinkling or telescoping and there is no excessive crushing of the pile. If the secondary flooring 40 is rolled too tightly, then the pile may be crushed and may require more grooming time, which increases the conversion time. As the roll of secondary flooring 40 increases in size, the arm 16 onto which the core 12 is mounted moves upwards via the pivot point. Once the secondary flooring 40 is rolled onto the core 12, the core motors 20 and the frame motors 18 are turned off. In some embodiments, the starting and stopping of the system is manual, so that an operator starts and stops the motors using a control box. In other embodiments, the system starts and stops automatically. In some situations, the system is only partially automated. For example, the system in some embodiments includes a sensor that senses the amount of secondary flooring on the core to determine when to turn off the motors. In some instances, only a portion of the secondary flooring is unrolled, so that the secondary flooring only covers a portion of the primary surface. This may be beneficial in situations where one type of flooring is desired on one part of the venue, and a different type of flooring is desired on another part of the venue.

The systems of this invention do not require that the secondary flooring surfaces have a specific tilt or pile angle, as was required with conventional systems. Unlike conventional systems, where the secondary flooring surface had to be reversed to maintain a certain pile angle so that the secondary flooring surface would roll up properly, systems of this invention function properly regardless of the tilt or angle of the secondary flooring surface, because the system is programmed to adjust for the tilt or angle and compensate for any variations by adjusting the torque and/or speed of the core motors.

Also provided is a method for rolling out the secondary flooring 40 from the core 12. As mentioned above, in some embodiments, the system is programmed to roll out the secondary flooring at a speed of 20 ft/min. The motors 20 and 18 (controlling the core 12 and frame 14 respectively) are started to begin the roll out process and the frame motors are configured to drive the frames 14 along the tracks 22 in a second direction 44. Although secondary flooring 40 is illustrated in FIG. 1 as rolled out in second direction 44, secondary flooring 40 could be rolled out in the opposite direction. As the frames 14 moves along the tracks 22, the secondary flooring 40 rolls off the core 12. In the roll out process, the frame adjustable speed drive units are programmed to maintain a fixed speed of the frames 14 along the tracks 22. As the diameter of the secondary flooring wrapped around the core changes, the speed of the core changes to accommodate this. Specifically, as the diameter of the core 12 reduces as more secondary flooring is unrolled off the core, the speed of the core 12 increases. As during roll up, the rack and spur gears of the track and frame (24 and 30 respectively) maintain alignment of the core 12 while the secondary flooring 40 is being rolled out as the frames progress along the tracks. The speed may be the same as that used throughout the roll up process or may be different. During the roll out process, the core 12 may operate in brake mode, or in other words, act as a brake to control the speed of the secondary flooring 40 rolling off the core 12. In some embodiments, the brake percentage is a percentage of the total capacity of the horse power of the core motor. Controlling the speed of the core 12 prevents the secondary flooring 40 from bagging as it comes off the core 12. In this way, the relationship between the speed of the core motor and the speed of the frame motors is constant to maintain constant tension on the secondary flooring. In some embodiments, a single speed for the core motor 20 is maintained throughout the roll out process. However, in other embodiments where the dimensions of the secondary flooring 40 are larger and thus the diameter is larger, the speed is adjusted during the roll out process. In these embodiments, the core adjustable speed drive units receive the position information from the LVD and adjust the speed of the core motor 20 based on the amount of secondary flooring 40 that remains on the core 12. As discussed above, the LVD indicates the position of the core relative to the primary surface, and thus indicates the diameter of the secondary flooring 40 on the core 12. The core adjustable speed drive unit controls the speed of the core motor 20 in a linear manner.

In one embodiment, the core motors 20 and the frame motors 18 are activated and deactivated at approximately the same time for both roll up and roll out. The acceleration and deceleration profiles of the motors are also approximately the same and follow a linear pattern. Other embodiments may use different acceleration and/or deceleration profiles, such as non-linear patterns, so long as the profiles are common between the motors.

This system allows the end user to convert an existing primary surface to a secondary flooring surface in a short period of time using a reduced amount of labor when compared with conventional systems. This system also allows the end user to choose from a number of different types of secondary flooring surfaces, such as either tufted or knitted synthetic turfs, a tall or short pile product, rubberized flooring systems, an infilled or non-infilled product, natural sod, or any other surface used to cover and/or protect a primary surface. The disclosed system is not limited to use in the athletic industry, but can be utilized whenever a primary surface is to be converted into a secondary flooring surface. Because the roll out and roll up procedure can be done so quickly, a primary surface can be converted to a secondary flooring surface in a fraction of the time it took with conventional systems.

The foregoing description is provided for describing various embodiments and structures relating to the invention. Various modifications, additions and deletions may be made to these embodiments and/or structures without departing from the scope and spirit of the invention.

We claim:

1. A conversion system for installing or removing a secondary flooring surface over a primary flooring surface, comprising:

a core for storing the secondary flooring surface when not in use, wherein rotation of the core is driven by at least one core motor and the at least one core motor is controlled by a core drive unit;

at least one track;

at least one frame driven by at least one frame motor along the track and connected to the core, wherein the at least one frame motor is controlled by a frame drive unit;

wherein the core motor drive unit controls a torque of the at least one core motor while the secondary flooring surface is rolling onto the core and the core motor drive unit controls a speed of the at least one core motor while the secondary flooring surface is rolling off of the core, and wherein the at least one frame drive unit controls a speed of the at least one frame motor to control the speed of the at least one frame on the at least one track.

2. The system of claim 1, further comprising an arm for supporting the core and the secondary flooring surface, wherein the arm is attached to the at least one frame and rotates relative to the at least one frame as the secondary flooring surface rolls on or off the core.

3. The system of claim 2, further comprising a hydraulic lift connected to the frame that assists with the movement of the arm supporting the core.

4. The system of claim 1, wherein the frame further comprises at least one gear that cooperates with gear teeth located on the track.

5. The system of claim 4, wherein the at least one gear comprises a front gear, a rear, gear, a left gear, and a right gear.

6. The system of claim 1, wherein the at least one frame comprises two frames and the at least one track comprises two tracks.

7. The system of claim 6, wherein the system further comprises a registration system that determines the position of one of the two frames relative to the other of the two frames.

8. The system of claim 7, wherein the registration system adjusts the speed of at least one of the frames so that the relative speed of the two frames differs.

9. A system for installing or removing a secondary flooring surface, comprising:

a core for storing the secondary flooring surface when not in use, wherein the core is driven by at least one core motor and the at least one core motor is controlled by a core motor drive unit;

two tracks positioned generally parallel to one another;

two frames, each configured to cooperate with one of the two tracks, wherein one of the frames is positioned at a first end of the core and the second one of the frames is positioned at a second end of the core;

wherein each of the two frames is driven along a length of its respective track by at least one frame motor and the at least one frame motor is controlled by a frame drive unit;

wherein the core drive unit controls a torque of the at least one core motor while the secondary flooring surface is rolling onto the core and the core motor drive unit controls a speed of the at least one core motor while the secondary flooring surface is rolling off the core; and wherein the frame drive unit controls a speed of the at least one frame motor.

10. The system of claim 9, further comprising two arms for supporting the core and the secondary flooring surface, wherein one arm is connected to each of the two frames and wherein each of the arms is positioned with respect to an end of the core and wherein the arms rotate with respect to the frames as the secondary flooring surface rolls on or off the core.

11. The system of claim 9, further comprising a transducer that determines the relative position of the core.

12. The system of claim 9, wherein the secondary flooring rolls off the core and onto a primary surface as the two frames are driven in a first direction along the two tracks.

13. The system of claim 9, wherein the secondary flooring rolls onto the core from a primary surface as the two frames are driven in a second direction along the two tracks.

14. The system of claim 9, wherein the two frames each further comprise at least one gear that cooperates with gear teeth located on the tracks.

15. A method for rolling up a secondary flooring surface, comprising:

controlling a core motor to operate at a predefined torque, wherein the core motor controls rotation of a core as the secondary flooring surface rolls onto the core;

coupling the core to a frame;

driving the frame along a length of a track by controlling a frame motor to operate at a predefined speed, wherein the frame motor controls the speed of the frame along the track; and wherein the predefined speed is based on a length of the secondary flooring surface and a time allocated to roll up the secondary flooring surface and wherein the predefined speed is capable of adjustment based on a registration process.

16. The method of claim 15, wherein the predefined torque is maintained as the secondary flooring surface rolls onto the core.

17. The method of claim 15, wherein the registration comprises adjusting the speed of the frame relative to another frame so that the relative speed of the frames differs.

18. A method for rolling out a secondary flooring surface, comprising:

controlling a speed of a core motor, wherein the core motor controls rotation of a core as the secondary flooring surface rolls off the core;

coupling the core to a frame;

driving the frame along a length of a track by controlling a frame motor to operate at a predefined speed, wherein the frame motor controls the speed of the frame along the track, and wherein the predefined speed is based on a length of the secondary flooring surface and a time allocated to roll out the secondary flooring surface;

determining an amount of the secondary flooring surface on the core; and using the amount of the secondary flooring surface on the core to adjust the speed of the core motor.

19. The method of claim 18, wherein controlling the frame motor to operate at a predefined speed comprises maintaining the predefined speed as the secondary flooring surface rolls off the core subject to adjustments based on the position of the frame.

20. The method of claim 18, further comprising adjusting the speed of the frame relative to another frame using a registration process so that the relative speed of the frames differs.

* * * * *